US010405611B2

(12) United States Patent
Droege et al.

(10) Patent No.: US 10,405,611 B2
(45) **Date of Patent: *Sep. 10, 2019**

(54) ARTICLE OF FOOTWEAR WITH A LATERAL OFFSET HEEL STUD

(71) Applicant: NIKE, Inc., Beaverton, OR (US)

(72) Inventors: John Droege, Portland, OR (US); Collin K. Eder, Portland, OR (US); Doug D. Wilken, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 820 days.

This patent is subject to a terminal disclaimer.

(21) Appl. No.: 14/794,995

(22) Filed: Jul. 9, 2015

(65) Prior Publication Data

US 2015/0374071 A1 Dec. 31, 2015

Related U.S. Application Data

(63) Continuation of application No. 13/303,793, filed on Nov. 23, 2011, now Pat. No. 9,101,178.

(51) Int. Cl.

| | |
|---|---|
| ***A43C 15/16*** | (2006.01) |
| ***A43B 13/22*** | (2006.01) |
| ***A43B 5/00*** | (2006.01) |

(52) U.S. Cl.

CPC ..... *A43C 15/161* (2013.01); *A43B 5/00* (2013.01); *A43B 13/223* (2013.01); *A43C 15/16* (2013.01); *A43C 15/165* (2013.01); *A43C 15/167* (2013.01)

(58) Field of Classification Search

CPC ..... A43C 15/16; A43C 15/161; A43C 15/165; A43C 15/167

USPC ..... 36/59 C, 59 R, 67 A, 67 R, 83, 88, 103, 36/105, 113, 114, 126, 127, 128, 129, 36/130, 131

See application file for complete search history.

(56) References Cited

U.S. PATENT DOCUMENTS

| | | | | |
|---|---|---|---|---|
| 1,568,064 A | | 1/1926 | Goldman | |
| 3,988,840 A | | 11/1976 | Minihane | |
| 4,067,123 A | | 1/1978 | Minihane | |
| 4,085,527 A | * | 4/1978 | Riggs | A43B 5/06 36/114 |
| 4,315,374 A | * | 2/1982 | Sneeringer | A43B 13/223 36/126 |

(Continued)

FOREIGN PATENT DOCUMENTS

| | | |
|---|---|---|
| CN | 2228286 Y | 6/1996 |
| CN | 104053375 A | 9/2014 |

(Continued)

OTHER PUBLICATIONS

European Patent Office, Communication pursuant to Article 94(3) EPC for EP Application No. 12806200.7, dated Jan. 19, 2017.

(Continued)

*Primary Examiner* — Alissa J Tompkins
*Assistant Examiner* — Cameron A Carter
(74) *Attorney, Agent, or Firm* — Hongman LLP; Matthew H. Szalach; Jonathan P. O'Brien

(57) ABSTRACT

An article of footwear having a sole that provides friction between the playing surface and the player's foot. In some embodiments, the article footwear includes a sole having a plurality of elongated studs in the heel region in addition to a back lateral stud having a rounded or circular shape located in the back lateral area of the heel.

18 Claims, 7 Drawing Sheets

(56) References Cited

U.S. PATENT DOCUMENTS 4,327,503 A * 5/1982 Johnson ..... A43B 13/223 36/129
4,392,312 A 7/1983 Crowley et al.
4,590,693 A * 5/1986 Kawashima ..... A43C 15/162 36/126
4,974,347 A * 12/1990 Funderburk ..... A43B 13/223 36/114
5,201,126 A * 4/1993 Tanel ..... A43B 3/0042 36/134
5,339,544 A 8/1994 Caberlotto
5,461,801 A * 10/1995 Anderton ..... A43B 3/0052 24/713.4
D391,044 S * 2/1998 Backus ..... D2/954
5,887,371 A * 3/1999 Curley, Jr. ..... A43B 13/26 36/127
6,016,613 A * 1/2000 Campbell ..... A43B 5/001 36/127
6,018,893 A * 2/2000 Workman ..... A43C 15/00 36/134
6,557,270 B2 5/2003 Nakano et al.
6,705,027 B1 * 3/2004 Campbell ..... A43B 5/001 36/127
6,892,479 B2 * 5/2005 Auger ..... A43B 5/02 36/128
6,973,745 B2 * 12/2005 Mills ..... A43B 3/0068 36/113
6,973,746 B2 12/2005 Auger et al.
7,007,410 B2 * 3/2006 Auger ..... A43B 5/02 36/116
7,010,871 B2 3/2006 Sussmann
7,086,183 B2 8/2006 Wood et al.
7,143,530 B2 12/2006 Hudson et al.
7,181,868 B2 * 2/2007 Auger ..... A43B 5/02 36/103
7,441,350 B2 10/2008 Auger et al.
8,510,974 B2 8/2013 Yue et al.
8,782,928 B2 * 7/2014 Amos ..... A43B 13/141 36/102
8,806,779 B2 8/2014 Auger et al.
8,966,787 B2 3/2015 Auger et al.
9,101,178 B2 8/2015 Droege et al.
2004/0000071 A1 * 1/2004 Auger ..... A43B 5/02 36/59 R
2004/0000075 A1 * 1/2004 Auger ..... A43B 5/02 36/128
2005/0016029 A1 * 1/2005 Auger ..... A43B 1/0072 36/134
2005/0097782 A1 * 5/2005 Mills ..... A43B 3/0068 36/126
2006/0064905 A1 3/2006 Hudson et al.
2006/0150442 A1 * 7/2006 Auger ..... A43B 5/02 36/103
2006/0242863 A1 * 11/2006 Patmore ..... A43B 13/26 36/127
2007/0240337 A1 10/2007 Belluto
2007/0266597 A1 11/2007 Jones
2008/0216352 A1 * 9/2008 Baucom ..... A43B 13/026 36/83
2008/0216362 A1 * 9/2008 Gerber ..... A43B 5/02 36/67 A
2008/0301973 A1 * 12/2008 Lee Tsai ..... A43C 15/061 36/7.1 R
2009/0100718 A1 4/2009 Gerber
2009/0113765 A1 5/2009 Robinson, Jr. et al.
2009/0211118 A1 * 8/2009 Krikorian ..... A43C 15/16 36/134
2009/0293315 A1 * 12/2009 Auger ..... A43B 5/02 36/114
2011/0088287 A1 * 4/2011 Auger ..... A43B 5/02 36/107
2011/0197475 A1 * 8/2011 Weidl ..... A43B 1/0009 36/107
2011/0197478 A1 * 8/2011 Baker ..... A43B 13/12 36/59 R
2011/0203136 A1 * 8/2011 Auger ..... A43C 15/168 36/61
2011/0232136 A1 9/2011 Curley
2011/0247237 A1 10/2011 Jara et al.
2012/0180343 A1 7/2012 Auger et al.
2013/0047465 A1 * 2/2013 Auger ..... A43B 13/223 36/66
2013/0067765 A1 * 3/2013 Auger ..... A43B 5/02 36/31
2013/0067772 A1 * 3/2013 Auger ..... A43B 5/02 36/103
2013/0067773 A1 * 3/2013 Auger ..... A43B 5/02 36/103
2013/0067774 A1 * 3/2013 Auger ..... A43B 5/02 36/103
2013/0067776 A1 * 3/2013 Auger ..... A43B 5/02 36/25 R

FOREIGN PATENT DOCUMENTS

DE 2454241 A1 5/1976
DE 37 03 932 A1 8/1988
DE 198 17 579 A1 10/1999
EP 1 392 136 A1 3/2004
FR 1 385 256 A 1/1965
JP 9-308505 A 12/1997
WO 00/30483 A1 6/2000
WO 2013/077974 A1 5/2013

OTHER PUBLICATIONS

Observation of Response to the First Office Action filed Dec. 14, 2015, 4 pages.
International Search Report and Written Opinion dated Mar. 7, 2013 in PCT/US2012/062648.
International Preliminary Report on Patentability (inducting Written Opinion of the ISA) dated Jun. 5, 2014 in PCT/US2012/062848.
Voluntary Amendments filed Jan. 9, 2015 in Chinese Patent Application No. 201280057390.5.
Office Action dated Jul. 29, 2015 in Chinese Patent Application No. 201280057390.5.
Voluntary Amendments filed Feb. 9, 2015 in European Patent Application No. 12806200.7.
Response to Office Action, filed Dec. 14, 2015 in CN Application No. 201280057390.5, 4 pages.
Second Office Action dated Mar. 25, 2016 in Chinese Patent Application No. 201280057390.5, 14pp.
English Translation of Search Report for Chinese Application No. 201280057390.5, dated Mar. 17, 2016, 2 pages.
Response to the Second Office Action filed Jun. 12, 2016 in Chinese Patent Application No. 201280057390.5, 30 Pages.
European Patent Office, Communication Pursuant to Article 94(3) EPC for EP Application No. 12806200.7, dated Mar. 22, 2018.

* cited by examiner

ARTICLE OF FOOTWEAR WITH A LATERAL OFFSET HEEL STUD

CROSS-REFERENCE TO RELATED APPLICATIONS

This application is a continuation of Droege et al., U.S. Patent Application Publication No. 2013/0125423, published on May 23, 2013, the entire disclosure of which is incorporated herein by reference.

BACKGROUND

The present invention relates generally to an article of footwear that provides traction during athletic activity.

Various competitive athletic activities require players to make changes in directional movement quickly on a variety of playing surfaces. For example, the game of soccer requires players to make many directional changes in response to the position of a soccer ball on the playing field. When kicking a soccer ball, a player must plant a foot near the soccer ball with one foot in order to kick the ball with the opposite foot. The foot that is planted near the ball prior to kicking requires a certain amount of friction between the playing surface and the players planted foot in order to provide the player with a sufficient amount of balance and stability to properly kick the ball. The required friction may be provided by studs arranged on the sole of the footwear.

Generally, studs on the sole of the footwear may provide a degree of friction between the player's foot and the playing field. The friction caused by the studs on the planted foot may provide the player with additional stability enabling the player to kick the ball with unplanted foot.

SUMMARY

In one aspect, an article of footwear is disclosed. In some embodiments, the article of footwear may include a sole structure having a heel region, wherein the heel region has a medial edge, a lateral edge, a forward portion and a back edge. In some embodiments, the article of footwear may also include a first plurality of elongated studs associated with a medial edge in the heel region, wherein each elongated stud extends approximately a first distance from a surface of the sole in the heel region, wherein a longitudinal axis of each of the elongated studs is oriented in substantially the same direction as the medial edge of the sole adjacent to each cleat. In some embodiments, the article of footwear may also include a second plurality of elongated studs associated with a lateral edge in the heel region, wherein each elongated stud extends approximately the first distance from the surface of the sole in the heel region, wherein a longitudinal axis of each of the elongated studs is oriented in substantially the same direction as the lateral edge of the sole adjacent to each cleat. In some embodiments, the article of footwear may also include a back lateral stud having a rounded shape associated with the back lateral edge of the heel, wherein the back lateral stud extends approximately a second distance from the sole.

In another aspect, one embodiment of an article of footwear may include a sole structure having a surface, a forefoot region and a heel region, wherein the heel region has a medial edge, lateral edge, forward region and back edge. In some embodiments, the article of footwear may also include a plurality of elongated studs extending approximately a first distance from a surface of the heel, wherein a longitudinal axis of each of the elongated studs are substantially oriented in the direction of the forefoot region. In some embodiments, the article of footwear may also include a back lateral stud associated with the back lateral edge of the heel, wherein the back lateral stud has a rounded shape, an outer surface, a base located on the surface of the sole, and a top surface opposite the base, wherein the back lateral stud extends approximately a second distance from the surface of the sole. In some embodiments, the article of footwear may also include a first blade-like support structure having a first edge, a second edge and a third edge, wherein the first edge is attached to the surface of the sole, wherein the second edge is attached to the outer surface of the back lateral stud from the surface of the sole to a first distance from the top surface of the back lateral stud, and wherein the third edge slopes from the first distance from the top surface of the back lateral stud to the surface of the heel. In some embodiments, the article of footwear may also include a second blade-like support structure having a first edge, a second edge and a third edge, wherein the first edge is attached to the surface of the sole, wherein the second edge is attached to the outer surface of the back lateral stud from the surface of the sole to a second distance from the top surface of the back lateral stud, and wherein the third edge slopes from the second distance from the top surface of the back lateral stud to the surface of the heel. In some embodiments, the article of footwear may also include a third blade-like support structure having a first edge, a second edge and a third edge, wherein the first edge is attached to the surface of the sole, wherein the second edge is attached to the outer surface of the back lateral stud from the surface of the sole to a third distance from the top surface of the back lateral stud, and wherein the third edge slopes from the third distance from the top surface of the back lateral stud to the surface of the heel.

In another aspect, an article of footwear may have a sole structure having a forefoot region and a heel region, wherein the heel region has a medial edge, lateral edge, forward region and back edge. In some embodiments, the article of footwear may also include a plurality of elongated studs extending approximately a first distance from a surface of the heel, wherein a longitudinal axis of each of the elongated studs are substantially oriented in the direction of the forefoot region, wherein each elongated stud has a flat top surface. In some embodiments, the article of footwear may also include a back lateral circular stud associated with the back lateral edge of the heel, the back lateral circular stud having a first circular portion extending from the heel, wherein the first circular portion has a first radius and a flat top surface, wherein the back lateral circular stud having a second circular portion having a second radius extending from the flat top surface of the first circular portion, wherein the second radius is less than the first radius.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
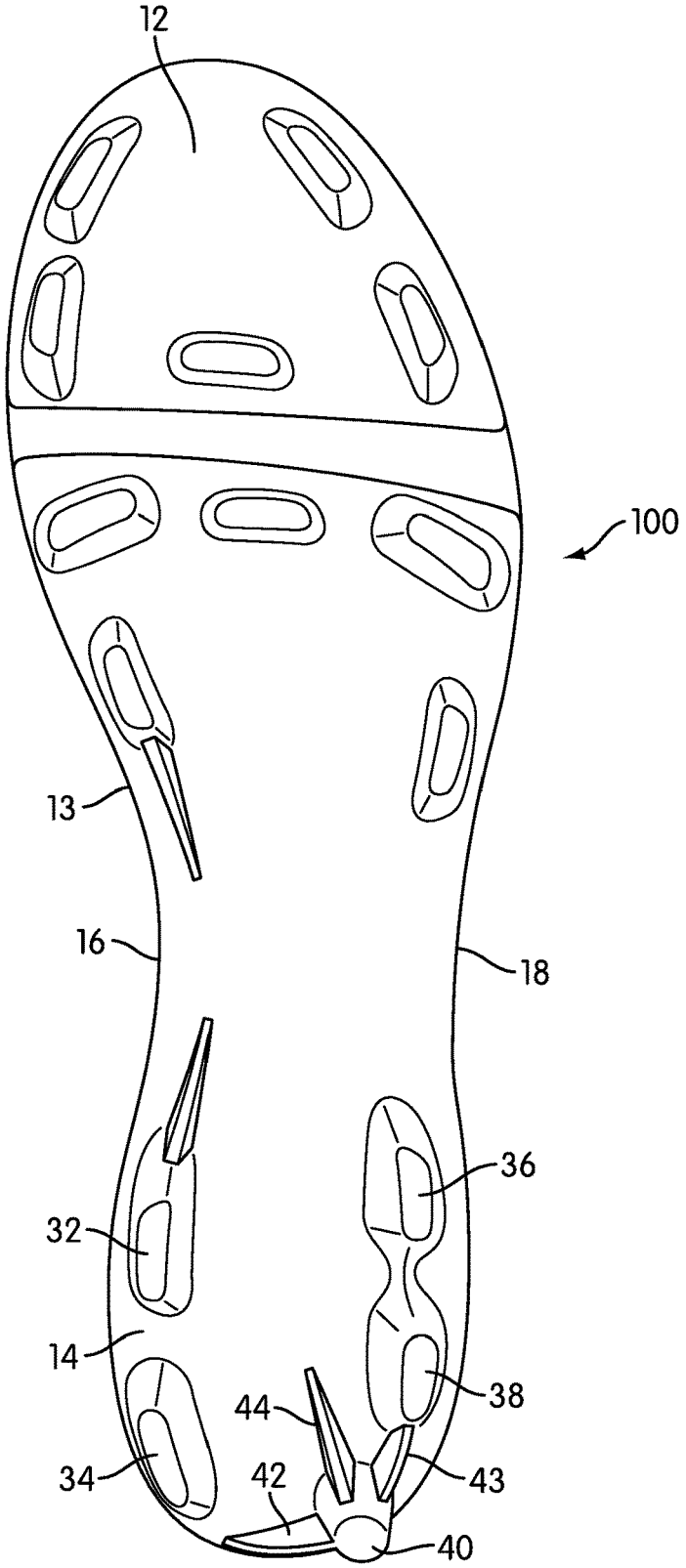
FIG. 1 is a plan view of one embodiment of a sole of an article of footwear.

FIG. 1 illustrates a bottom view of an embodiment of a sole structure 100, which may be incorporated into an article of footwear. For clarity, the following detailed description discusses an embodiment, in the form of a sole structure for a soccer shoe, but it should be noted that the present invention could take the form of a sole structure for any article of footwear including, but not limited to: hiking boots, soccer shoes, football shoes, sneakers, rugby shoes, basketball shoes, baseball shoes as well as other kinds of shoes. As shown in FIG. 1, sole structure 100, is intended to be used with a left foot; however, it should be understood that the following discussion may equally apply to a mirror image of sole structure 100 that is intended for use with a right foot.

For consistency and convenience, directional adjectives are employed throughout this detailed description corresponding to the illustrated embodiments. The term "longitudinal" or "longitudinally" as used throughout this detailed description and in the claims refers to a direction extending a length of an article. In some cases, the longitudinal axis is the axis extending through the longest dimension of a component. For example, the longitudinal axis of an elongated cleat may be the direction extending through the longest portion of the elongated cleat.

The term "medial plane of the body" as used throughout this detailed description and in the claims refers to the plane that divides the human body into a right and left side. The term "lateral" as used throughout this detailed description and in the claims refers to a region or direction extending away from the medial plane of the body. For example, the lateral side of the foot may refer to the side of the foot facing away from the center of the body. Similarly, the term "medial" as used throughout this detailed description and in the claims refers to a region or direction extending towards the medial plane of the body. For example, the medial side of the foot may refer to the side of the foot facing towards the center of the body.

Furthermore, the term "vertical" or "central" as used throughout this detailed description and in the claims refers to a direction generally perpendicular to a direction that is parallel to the ground. Furthermore, the term "vertical axis" or "central axis" as used throughout this detailed description and in the claims refers to a direction that extends generally away from the sole of the foot. For example, in cases where an article is planted flat on a ground surface, the vertical or central direction may extend from the sole towards the ground surface. It will be understood that each of these directional adjectives may be applied to individual components of an article, such as an upper and/or a sole structure.

The studs discussed herein may vary in size in different dimensional directions. It should be understood that the terms "length" and "width" as used throughout this detailed description and in the claims refers to a direction generally associated with the longest and shortest dimensions, respectively, of an element in the plane parallel to the sole structure. It should also be understood that the term "height" as used throughout this detailed description and in the claims refers to a direction generally associated with the distance of an element as measured from the sole structure in the plane perpendicular to the sole structure. In some embodiments, the length and/or width of the studs may vary. Similarly, in some embodiments, the approximate heights of each stud may vary.

Referring to FIG. 1, for purposes of reference, sole structure 100, or simply sole 100, may be divided into a forefoot region 12, midfoot region 13, and heel region 14. Forefoot region 12 may be generally associated with the toes and joints connecting the metatarsals with the phalanges. Midfoot region 13 may be generally associated with the arch of a foot. Likewise, heel region 14 may be generally associated with the heel of a foot, including the calcaneus bone.

In addition, sole 100 may include a medial edge 16 and lateral edge 18. In particular, medial edge 16 may refer to the edge of the sole facing towards the center of the body. Similarly, the lateral edge 18 may refer to the region of the sole that is facing away from the center of the body. Furthermore, both medial edge 16 and lateral edge 18 may extend through forefoot region 12, midfoot region 13, and heel region 14.

It will be understood that forefoot region 12, midfoot region 13, and heel region 14 are only intended for purposes of description and are not intended to demarcate precise regions of sole 100. Likewise, medial edge 16 and lateral edge 18 are intended to represent generally two portions or sides of the sole 100, rather than precisely demarcating the sole 100 into two halves. In addition, forefoot region 12, midfoot region 13, and heel region 14, as well as medial edge 16 and lateral edge 18, can also be applied to individual components of an article of footwear, such as a sole structure and/or an upper.

In some embodiments, sole 100 may be configured to provide traction for the wearer. In addition to providing traction, sole 100 may attenuate ground reaction forces when compressed between the foot and the ground during walking, running or other ambulatory activities. The configuration of sole 100 may vary significantly in different embodiments to include a variety of conventional or non-conventional structures. In some embodiments, sole 100 may include different components. For example, sole 100 may include an outsole, a midsole, and/or an insole. In some cases, one or more of these components may be optional.

In some cases, sole 100 may be configured according to one or more types of ground surfaces on which sole 100 may be used. Examples of ground surfaces include, but are not limited to: natural turf, synthetic turf, dirt, natural grass, soft natural grass, as well as other surfaces. In some embodiments, sole 100 may be provided with one or more cleat systems comprising a plurality of cleat members or stud members. The term "cleat members" or "stud members" as used in this detailed description and throughout the claims includes any provisions disposed on a sole for increasing traction through friction or penetration of a ground surface. Typically, cleat systems and/or cleat members may be configured for football, soccer, baseball or any type of activity that requires traction.

Sole 100 may include one or more cleat systems comprising a plurality of cleat members that extend away from the surface of the sole 100. Generally, cleat systems and/or cleat members may be associated with sole 100 in any manner. In some embodiments, cleat systems and/or cleat members may be integrally formed with sole 100. In other embodiments, sole 100 may include a partially rigid plate that extends across a substantial majority of a lower surface of sole 100. In some cases, cleats systems and/or cleat members may be attached to a partially rigid plate, such as by being screwed into holes within the plate or using any other provisions. Still further, in some cases, some cleats systems and/or cleat members may be integrally formed with sole 100. In still other cases, cleat systems and/or cleat members may be attached to and/or integrally formed with a partially rigid plate.

An article of footwear including cleat systems and/or cleat members can include provisions for maximizing traction between a sole and multiple types of ground surfaces. In some embodiments, a sole 100 can include cleat systems and/or cleat members disposed in different locations to achieve maximum traction on multiple types of surfaces. In other embodiments, a sole 100 can include distinct types of cleat systems and/or cleat members that each maximize traction for a distinct type of surface.

In some embodiments, sole 100 may include cleat members arranged as shown in FIG. 1 in the forefoot region 12 and midsole region 13. In other embodiments, the sole 100 may include cleat members arranged as shown in co-pending patent application titled "Forefoot Secondary Studs," by John Droege, and assigned to Nike, the entirety of which is hereby incorporated by reference.

FIG. 1 also shows cleat members in the heel region 14. For example, heel region 14 may include a first elongated stud 32, second elongated stud 34, a third elongated stud 36 and a fourth elongated stud 38. In some cases, the longitudinal axis of the first elongated stud 32 and second elongated stud 34 may run in substantially the same direction as the medial edge 16 of the heel 14. In some cases, the longitudinal axis of the third elongated stud 36 and fourth elongated stud 38 may run in substantially the same direction as the lateral edge 18 of the heel 14. The heel region 14 may also include a back lateral stud 40 having a first support structure 42, a second support structure 43, and a third support structure 44 that will be discussed in more detail in FIGS. 2 and 4 below.

Figure 2:
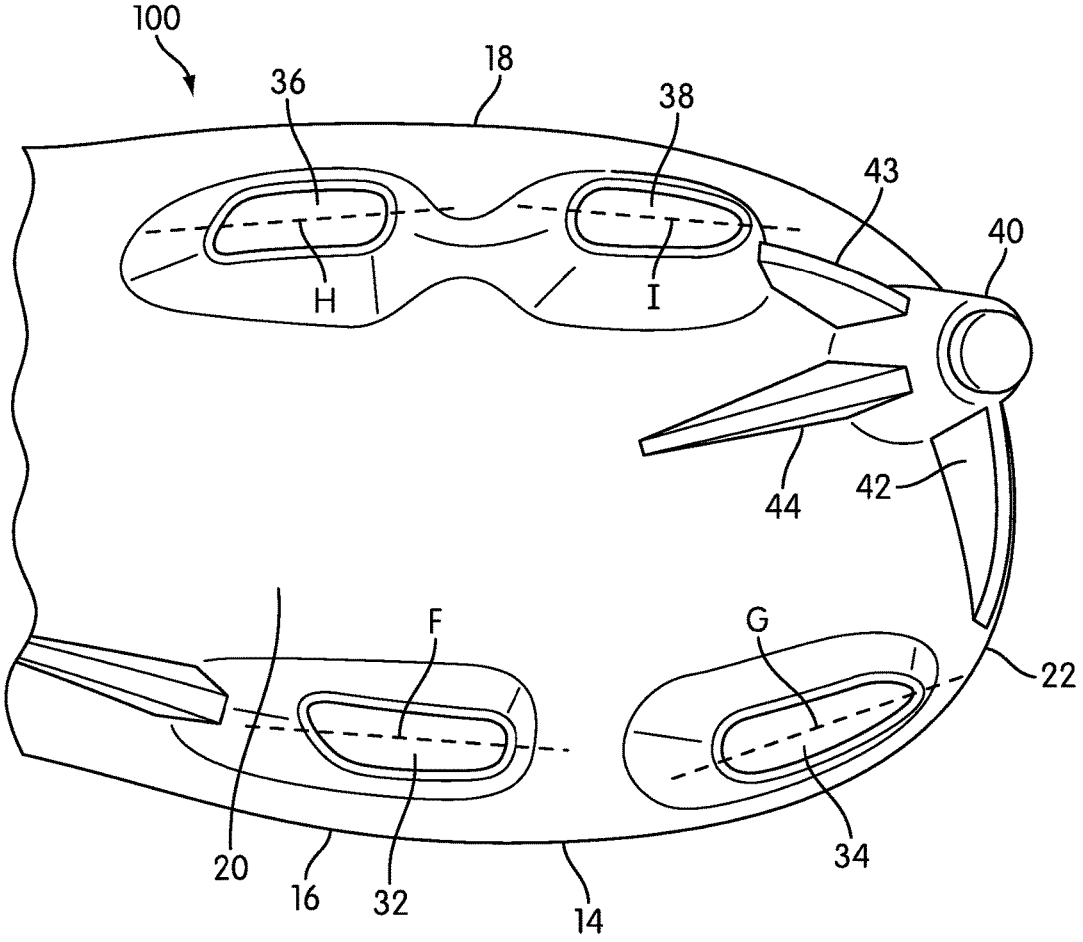
FIG. 2 is an enlarged view of the heel region of the sole shown in FIG. 1.

FIG. 2 is an enlarged plan view of the cleat arrangement on the heel region 14 of the sole 100 shown in FIG. 1. The heel region 14 includes a front portion 20, a back edge 22, as well as a lateral edge 18 and a medial edge 16. The heel region 14 may include a first elongated stud 32 and a second elongated stud 34 associated with the medial edge 16 of the heel 14. In some embodiments, the first elongated stud 32 may have a longitudinal axis F that runs in substantially the same direction as the medial edge 16 of the sole adjacent to the first elongated stud 32. In some embodiments, the second elongated stud 34 may have a longitudinal axis G that runs in substantially the same direction as the medial edge 16 of the sole adjacent to the second elongated stud 34.

The heel region may also include a third elongated stud 36 and a fourth elongated stud 38 associated with the lateral edge 18 of the heel 14. In some embodiments, the third elongated stud 36 may have a longitudinal axis H that runs in substantially the same direction as the lateral edge 18 of the sole adjacent to the third elongated stud 36. In some embodiments, the fourth elongated stud 38 may have a longitudinal axis I that runs in substantially the same direction as the lateral edge 18 of the sole adjacent to the fourth elongated stud 38. Although FIG. 2 shows a total of four elongated studs in the heel region 14, more or less studs may be arranged in the heel region 14 in other embodiments.

FIG. 2 also shows a back lateral stud 40 associated with the back edge 22 and lateral edge 18 of the heel 14. A first support structure 42, second support structure 43 and third support structure 44 may also be associated with the back lateral stud 40. These support structures may allow the back lateral stud 40 to penetrate further into the ground, allowing a player to plant their foot next to the ball while the opposite foot is brought into position to kick the ball. By allowing the back lateral stud 40 to penetrate further into the ground, the support structures provide a sufficient amount of friction between the surface and the player's foot in order to kick the ball with the opposite foot. In some embodiments, the studs shown in FIGS. 1 and 2 may have a protuberance extending from the top surface of each cleat, which is discussed in more detail in FIGS. 3 and 5.

Figure 3:
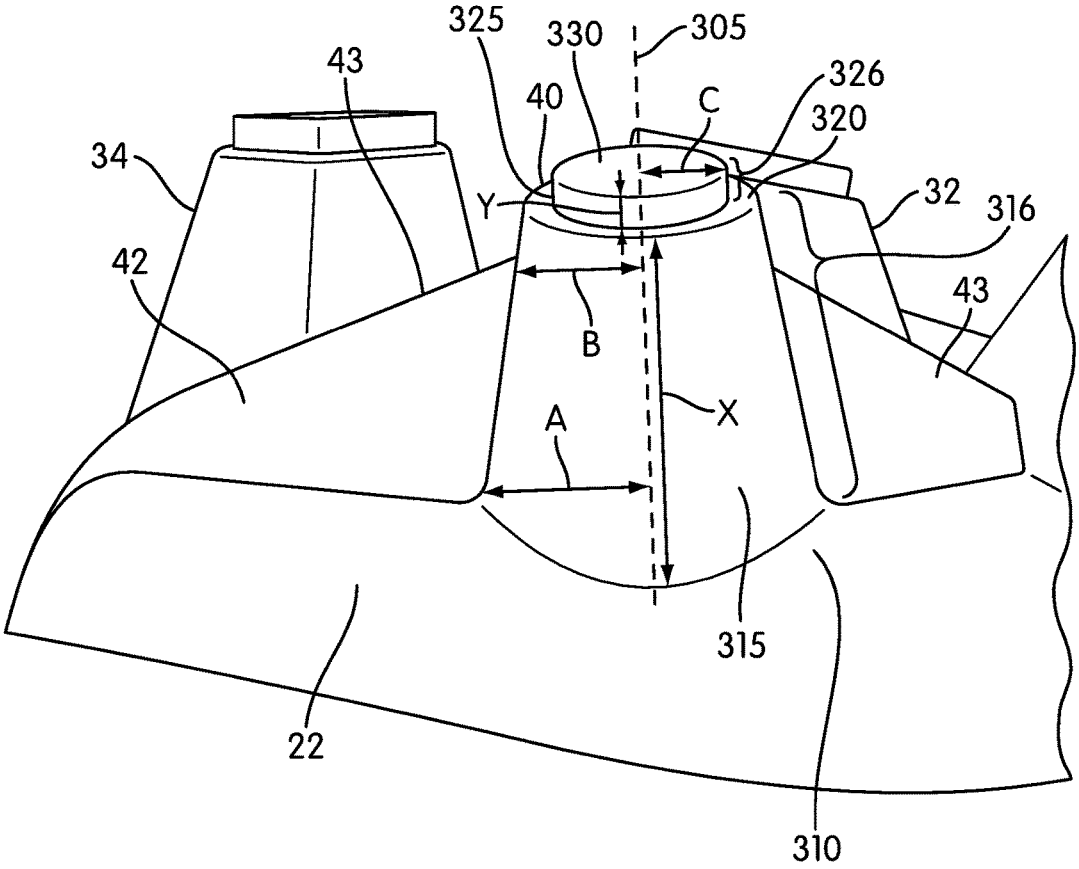
FIG. 3 is an isometric cross-section view of one embodiment of a back lateral stud.

FIG. 3 is an enlarged isometric view of one embodiment of a back lateral stud located in the heel region. Generally, studs may extend from the bottom surface of the sole in order to provide friction between the ground and the player. These studs may take on many different shapes in order to penetrate the ground and provide a sufficient amount of friction. In one embodiment, studs may have a first stud portion and second stud portion. The first stud portion may extend from the surface of the sole to some distance from the sole. The second stud portion may extend outwardly from one end of the first stud portion.

In one embodiment, the back lateral stud 40 may include a first stud portion 316 extending a first distance X from the surface 310 of the sole. In some embodiments, stud 40 may further include second stud portion 326. Second stud portion 326 may extend outwardly from top surface 320 of first stud portion 316. In some embodiments, second stud portion 326 may extend a second distance Y from the top surface 320 of the first stud portion.

In different embodiments, the geometry of each stud portion can vary. In some embodiments, a stud portion could have a substantially rounded shape. For example, in some cases, a stud portion could have an approximately cylindrical shape. In other cases, a stud portion could have an approximately conical shape. In one embodiment, one or more stud portions could have the approximate shape of a conical frustum. In other embodiments, a stud portion may not have a rounded shape.

In some cases, a stud portion may be square or rectangular in shape. In other cases, a stud portion may be triangular in shape. Additionally, it will be understood that while the current embodiments use elongated, rectangular and/or round cross-sectional shaped cleat members, cleat members may be formed in any of various shapes, including but not limited to hexagonal, cylindrical, conical, circular, square, rectangular, trapezoidal, diamond, ovoid, as well as other regular or irregular and geometric or non-geometric shapes.

In some embodiments, first stud portion 316 may have a generally rounded shape that is tapered. The first stud portion 316 may have a first radius A as measured from the centerline 305 of the stud to the outer surface 315 of the first stud portion 316 near the surface of the sole 310. In some embodiments, the top surface 320 of the first stud portion 316 may be substantially flat. In some embodiments, the top surface 320 of the first stud portion 316 may have a second radius B. In some embodiments, first radius A may be larger than second radius B. In one embodiment, the radius of first stud portion 316 may taper down from first radius A to second radius B. This tapered configuration may help stud 40 penetrate further into a ground surface. In other embodiments, first radius A may be equal to second radius B. In still other embodiments, first radius may be smaller than second radius B.

In some embodiments, second stud portion 326 may have a generally rounded shape. The second stud portion 326 may have a third radius C as measured from the centerline 305 of the stud to the outer surface 325 of the second stud portion. The second stud portion 326 may have a flat top surface 330 that is substantially parallel to the top surface 320 of the first stud portion 316. In different embodiments, the relative sizes of first stud portion 316 and second stud portion 326 can vary. In some embodiments, first radius A may be larger than second radius C, and second radius B may be larger than third radius C. Moreover, first distance X may be larger than second distance Y. With this configuration, second stud portion 326 is configured as a smaller stud portion that extends outwardly from first stud portion 316. In other embodiments, however, first distance X may be the same as, or greater than, second distance Y. Likewise, in other embodiments, third radius C could be similar in size to, or larger than, second radius B. In some embodiments, the cross-sectional surface area of the second stud portion 326 may be smaller than the cross-sectional surface area of the first stud portion 316. In other embodiments, the cross-sectional surface area of the second stud portion 326 may be the same as the first stud portion 316.

The second stud portion 326 may allow the back lateral cleat 40 to penetrate further into the ground. Since the second stud portion 326 may have a radius that is smaller than the first stud portion 316, the second stud portion 326 may form an initial hole in the surface of the playing field allowing the first stud portion 316 to penetrate the playing surface more deeply. This creates more friction between the playing surface and the player, thus providing more stability when the player is kicking the ball.

Figure 4:
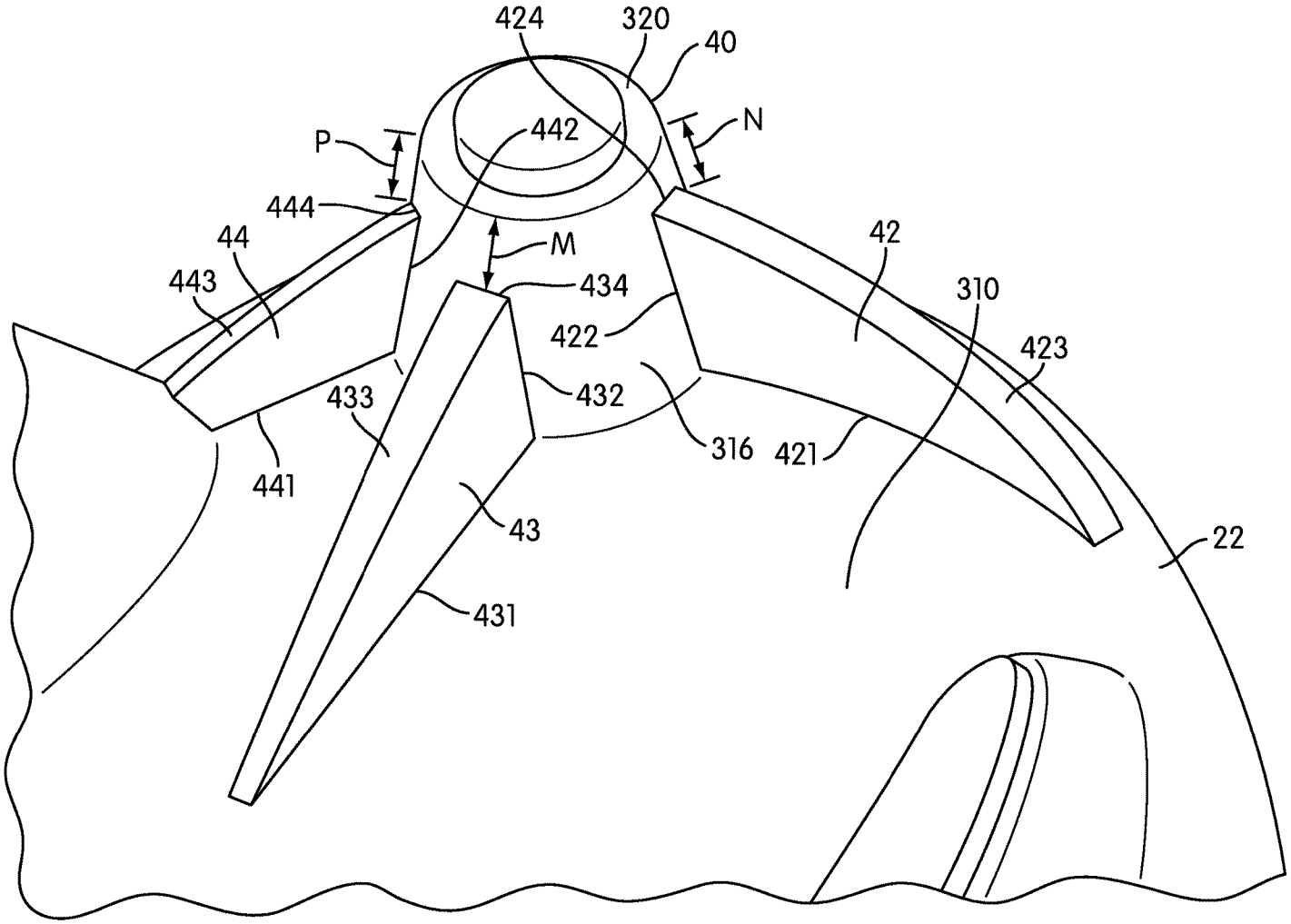
FIG. 4 is a perspective view of the heel region of the sole shown in FIG. 1.

FIG. 4 is a different perspective of the heel configuration shown in FIG. 3. FIG. 4 shows in more detail the first support structure 42, second support structure 43 and third support structure 44. The first support structure 42 has a first edge 421, a second edge 422, and a third edge 423. The first edge 421 is attached to the surface 310 of the sole, and runs in the same direction as the back edge 22 of the heel. The second edge 422 is attached to a portion of the first stud portion 316. The third edge 423 slopes from the top corner 424 of the second edge 422 to the surface 310 of the sole. In some cases, the third edge 423 runs in substantially the same direction as the first edge 421. In some embodiments, the third edge 423 may form a straight line between the top corner 424 of the second edge 422 and the surface 310 of the sole. In other embodiments, the third edge 423 may be curved, or form an arc.

In different embodiments, the height of first support structure 42 may vary. In some cases, first support structure 42 may extend to the top of stud 40. In other cases, first support structure 42 may not extend to the top of stud 40. In the current embodiment, the top corner 424, which is associated with second edge 422 and third edge 423, may be spaced apart from top surface 320 of stud portion 316. In one embodiment, the top corner 424 of the second edge 422 may be located a distance N from the top surface 320 of the first stud portion 316.

The second support structure 43 has a first edge 431, a second edge 432, and a third edge 433. The first edge 431 is attached to the surface 310 of the sole, and runs in a direction that is towards the forefoot region 12 (not shown in FIG. 4). The second edge 432 is attached to a portion of the first stud portion 316. The third edge 433 slopes from the top corner 434 of the second edge 432 to the surface 310 of the sole. In some cases, the third edge 433 runs in substantially the same direction as the first edge 431. In some embodiments, the third edge 433 may form a straight line between the top corner 434 of the second edge 432 and the surface 310 of the sole. In other embodiments, the third edge 433 may be curved, or form an arc.

In different embodiments, the height of second support structure 43 may vary. In some cases, second support structure 43 may extend to the top of stud 40. In other cases, second support structure 43 may not extend to the top of stud 40. In the current embodiment, the top corner 434, which is associated with second edge 432 and third edge 433, may be spaced apart from top surface 320 of first stud portion 316. In one embodiment, the top corner 434 of the second edge 432 may be located a distance M from the top surface 320 of the first stud portion 316.

The third support structure 44 has a first edge 441, a second edge 442, and a third edge 443. The first edge 441 is attached to the surface 310 of the sole, and runs in the same direction as the lateral edge 18 of the heel. The second edge 442 is attached to a portion of the first stud portion 316. The third edge 443 slopes from the top corner 444 of the second edge 442 to the surface 310 of the sole. In some cases, the third edge 443 runs in substantially the same direction as the first edge 441. In some embodiments, the third edge 443 may form a straight line between the top corner 444 of the second edge 442 and the surface 310 of the sole. In other embodiments, the third edge 443 may be curved, or may form an arc.

In different embodiments, the height of third support structure 44 may vary. In some cases, third support structure 44 may extend to the top of stud 40. In other cases, third support structure 44 may not extend to the top of stud 40. In the current embodiment, the top corner 444, which is associated with second edge 442 and third edge 443, may be spaced apart from top surface 320 of first stud portion 316. In one embodiment, the top corner 444 of the second edge 442 may be located a distance P from the top surface 320 of the first stud portion 316.

In some embodiments, the size of distance M, distance N and distance P could vary. In some cases, distance P, distance N and distance P could all equal one another. In other cases, they could be substantially different from one another. In still other cases, distance P and distance N could be substantially similar in size, while distance M could be substantially smaller or larger. Similarly, distance P and distance M could be substantially similar in size, while distance N could be substantially smaller or larger. In other cases, distance M and distance N could be substantially similar in size, while distance P could be substantially smaller or larger.

The first support structure 42, second support structure 43, and third support structure 44 may further help the back lateral stud 40 penetrate the playing surface by loosening up the surrounding surface as the back lateral stud 40 enters the ground. In addition, the first support structure 42, second support structure 43, and third support structure 44 may provide improved balance and stability as the player plants that foot in preparation for kicking the ball with the opposite foot.

Figure 5:
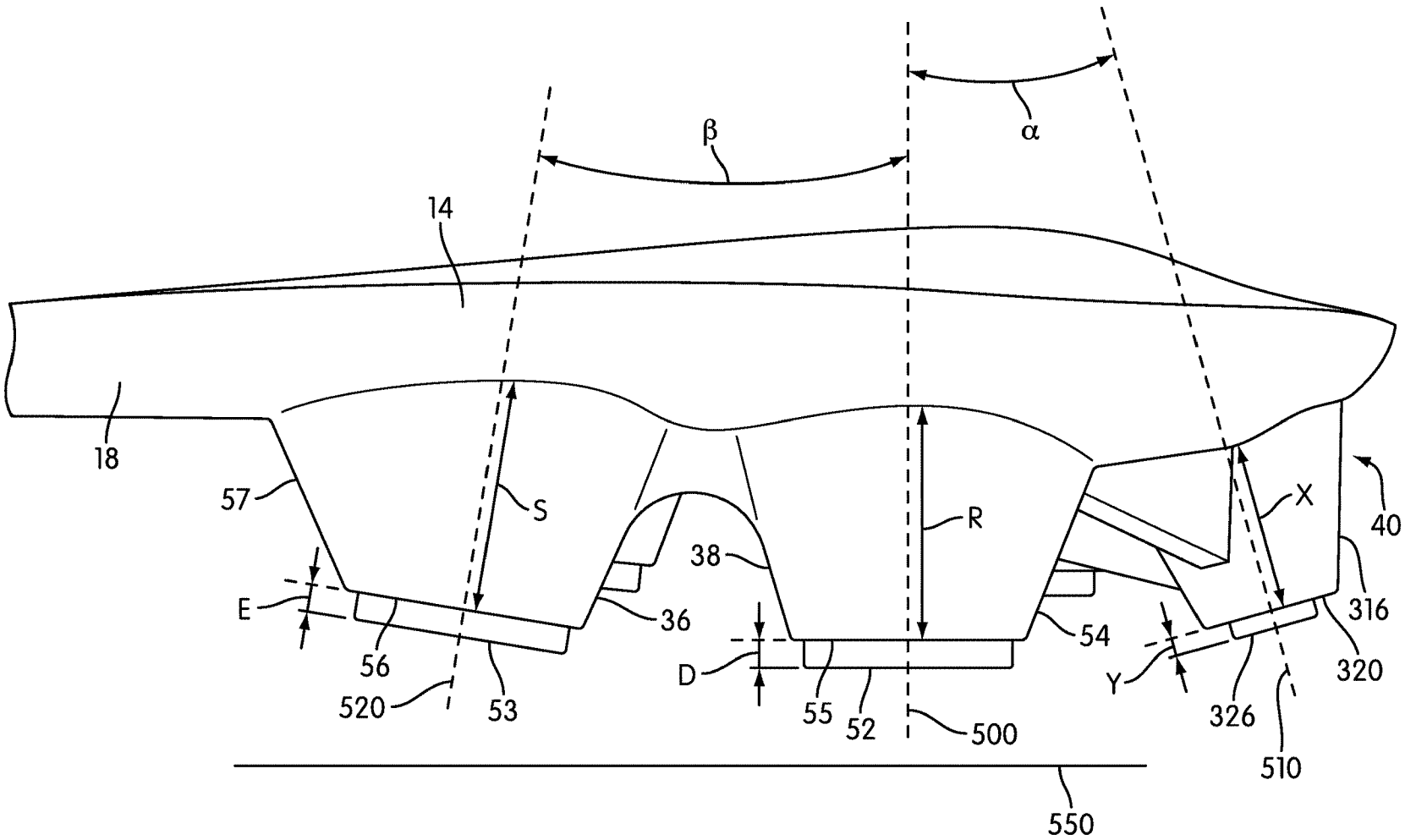
FIG. 5 is a side view of the heel region of the sole shown in FIG. 1.

FIG. 5 shows a side view of one embodiment of the heel. Referencing FIG. 5, the back lateral stud 40 may extend at an angle in relation to the elongated studs in the heel region. Additionally, the height of the back lateral stud 40 may vary in relation to the height of the elongated studs in the heel region.

In some embodiments, one or more elongated studs discussed previously can also include first stud portions and second stud portions. For example, in the current embodiment, the second elongated stud 38 may include a first elongated stud portion 54 extending a distance R from the sole. In some cases, the first elongated stud portion 54 may have a substantially flat top surface 55. In some cases, a second elongated stud portion 52 may extend a distance D from top surface 55.

Similarly, the first elongated stud 36 may include a first elongated stud portion 57 extending a distance S from the sole. The first elongated stud portion 57 may have a substantially flat top surface 56. In addition, a second elongated stud portion 53 may extend a distance E from the top surface 56.

In some embodiments, stud 54 and stud 57 may be elongated and tapered in shape. In some embodiments, the second elongated stud portion 53 of the first elongated stud 36 and the second elongated stud portion 52 of the second elongated stud 38 may have a surface facing the ground 550 that is substantially flat. In other cases, second elongated stud portions 52 and 53 may have a surface that forms any other geometric shape that allows the first elongated stud 36 and/or second elongated stud 38 to penetrate into the ground 550.

Generally, the height of first stud portion 316 of the back lateral stud 40 may vary with respect to the height of first elongated stud portion 54 on the second elongated stud 38. In some embodiments, the distance X (which is associated with the height of first stud portion 316 of the back lateral stud 40) may be greater than distance R (which is associated with the height of first elongated stud portion 54 of the second elongated stud 38). In other embodiments, the distance X may be greater than 50% of the distance R. In still other embodiments, the distance X may be greater than 60% of the distance R. Furthermore, in some embodiments, the distance X+Y may be greater than 60% of the distance R+D. In other words, in some cases, the combined height of first stud portion 316 and second stud portion 326 may be 60% greater than the combined height of first elongated stud portion 54 and second elongated stud portion 52 of the second elongated stud 38. This relationship between height of the back lateral stud 40 and the heights of the elongated studs allows the toe portion of the shoe to slightly lift off of the ground when the foot is planted on the ground while simultaneously providing support for the foot. Thus, having the back lateral stud 40 smaller in height than the elongated studs allows for the planted foot to be more accurately positioned once the foot is planted by allowing the toe region to be lifted up and moved slightly to the left or right. Having the back lateral stud 40 with a height that is 60% or greater than the elongated studs in the heel region limits the degree to which the toe region may be lifted from the ground, thus providing added stability to the planted foot.

Generally, the height of first stud portion 316 of the back lateral stud 40 may vary with respect to the height of first elongated stud portion 57 on the first elongated stud 36. In some embodiments, the distance X (which is associated with the height of the first stud portion 316 of the back lateral stud 40) may be greater than distance S (which is associated with the height of first elongated stud portion 57 of the first elongated stud 36). In other embodiments, the distance X may be greater than 50% of the distance S. In still other embodiments, the distance X may be greater than 60% of the distance S. Furthermore, in some embodiments, the distance X+Y may be greater than 60% of the distance S+E. In other words, in some cases, the combined height of first stud portion 316 and second stud portion 326 may be 60% or greater than the combined height of first elongated stud portion 57 and second elongated stud portion E of the first elongated stud 36.

Although not shown in FIG. 5, the third elongated stud 32 and fourth elongated stud 34 may have similar characteristics as described for the first elongated stud 36 and the second elongated stud 38. In some embodiments, the height relationship between the third elongated stud 32, fourth elongated stud 34 and back lateral stud 40 is similar to the height relationship described between the first elongated stud 36, second elongated stud 38 and back lateral stud 40.

For purposes of describing the orientation of one or more studs of sole 100, each stud may be associated with a central axis. The central axis is an axis that runs perpendicular to the lateral and longitudinal directions of each stud. In the current embodiment, the fourth elongated stud 38 may have a central axis 500 that is substantially perpendicular to the ground 550. In addition, back lateral stud 40 may be associated with central axis 510. Furthermore, third lateral stud 56 may be associated with central axis 520.

In some embodiments, the relative angle between back lateral stud 40 and other studs on heel region 14 of sole 100 can vary. As can be seen in FIG. 5, central axis 510 of back lateral stud 40 is at some angle $\alpha$ with the central axis 500 of the fourth elongated stud 38. In different embodiments, the value of angle $\alpha$ can vary. In some embodiments, the central axis 510 of the back lateral stud 40 may be at an approximately 15° angle relative to the central axis 500 of the fourth elongated stud 38. In some embodiments, the central axis 305 of the back lateral stud 40 may be at more than a 15° angle relative to the central axis 500 of the fourth elongated stud 38. In other embodiments, the central axis 305 of the back lateral stud 40 may be at less than a 15° angle relative to the central axis 500 of the fourth elongated stud 38.

The third elongated stud 36 may have a central axis 520 that is at some angle $\beta$ relative to the central axis 500 of the fourth elongated stud 38. For example, the central axis 520 of the third elongated stud 36 may form a 10° angle with respect to the central axis 500 of the fourth elongated stud 38. In other embodiments, the central axis of the third elongated stud 36 may be at more than a 10° angle relative to the central axis 500 of the fourth elongated stud 38. In still further embodiments, the central axis of the third elongated stud 36 may be at less than a 10° angle relative to the central axis 500 of the fourth elongated stud 38.

This angular relationship between the studs in the heel region allows the foot to roll slightly in the direction of the forefoot while advancing in a forward direction. This allows for improved traction when the player is running, accelerating or making a directional change.

Similarly, although not shown in FIG. 5, the second elongated stud 34 may have a central axis that is substantially perpendicular to the ground. The first elongated stud 32 may have a central axis that is at a 10° angle relative to the central axis of the second elongated stud 34. In other embodiments, the central axis of the first elongated stud 32 may be at more than or less than a 10° angle relative to the central axis of the second elongated stud 34. In some embodiments, the first elongated stud 32, second elongated stud 34, third elongated stud 36, fourth elongated stud 38 and back lateral stud 40 may have a central axis that is substantially perpendicular to the ground. In other embodiments, only the first elongated stud 32, second elongated stud 34, third elongated stud 36 and fourth elongated stud 38 have a central axis that is substantially perpendicular to the ground, while the back lateral stud 40 has a central axis that is at some angle to one or all of the elongated studs in the heel region. In other embodiments, the central axis of each elongated stud in the heel region may vary somewhat relative to one another.

Figure 6:
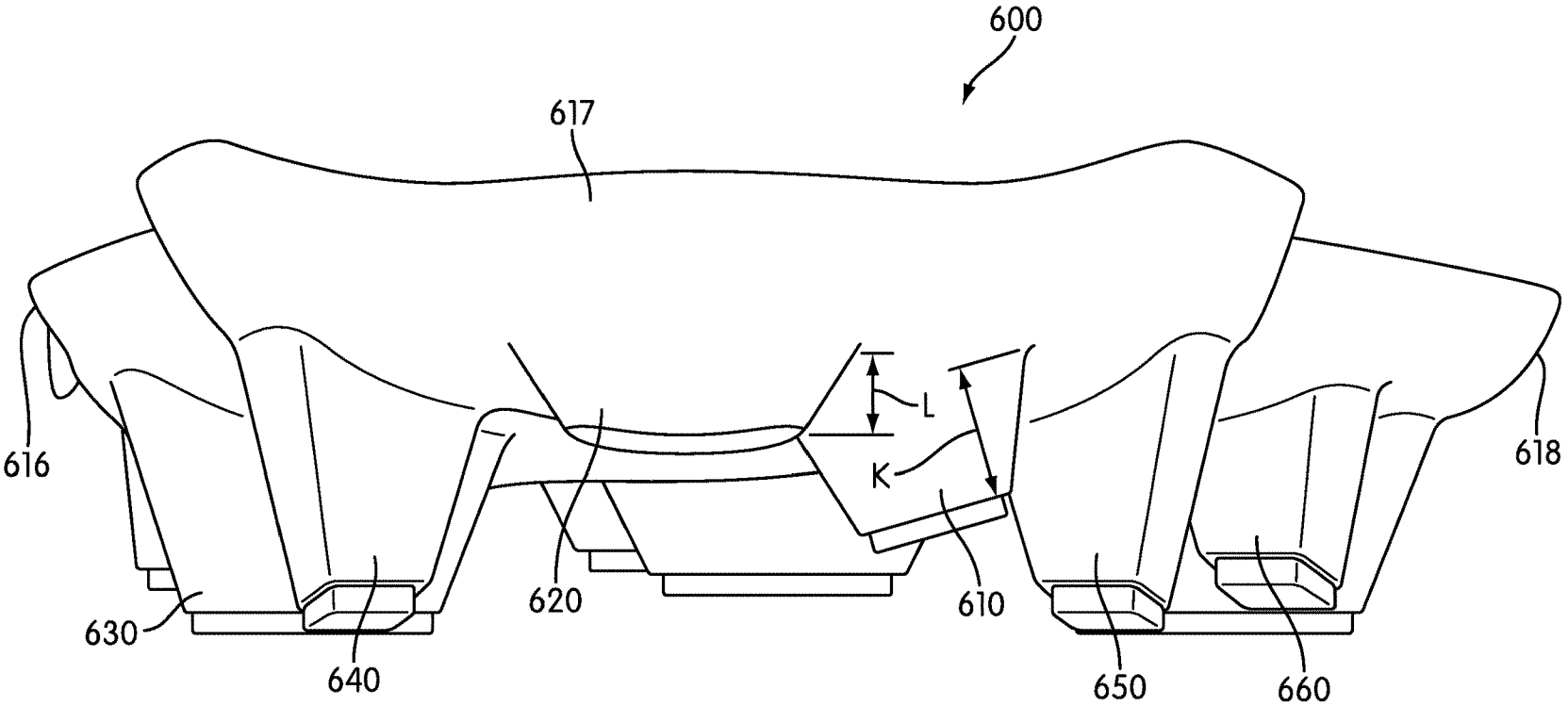
FIG. 6 is a rear view of another embodiment of a sole of an article of footwear.

Additional stability may be provided with the addition of a transversely oriented elongated cleat located in the back heel region, as shown in FIG. 6. Referring to an alternative embodiment illustrated in FIG. 6, an article of footwear may include a sole structure 600 having a medial edge 616, a lateral edge 618 and a back edge 617 of the heel area. In some embodiments, the sole may have a first elongated stud 630 and a second elongated stud 640 located along the medial edge 616 of the heel. Some embodiments may also include a third elongated stud 660 and a fourth elongated stud 650 along the lateral edge 618 of the heel. Some embodiments may also include a back lateral stud 610 associated with the back edge 617 of the heel near the lateral edge 618.

The cleat members in this embodiment may be formed in any of various shapes, including but not limited to elongated, rectangular and/or round cross-sectional shaped, hexagonal, cylindrical, conical, circular, square, rectangular, trapezoidal, diamond, ovoid, as well as other regular or irregular and geometric or non-geometric shapes. In some embodiments, the back lateral stud 610 will have a conical frustum shape.

Some embodiments may also include a fifth elongated stud 620 associated with the middle of the back edge 617 of the heel. The fifth elongated stud 620 may have a longitudinal axis that is substantially parallel to the back edge 617 of the heel. In other words, the fifth elongated stud 620 may have a longitudinal axis that is substantially perpendicular to the longitudinal axis of the first elongated stud 630, the second elongated stud 640, the third elongated stud 650 and/or the fourth elongated stud 660.

In some embodiments, the relative heights of fifth elongated stud 620 and back lateral stud 620 can vary. In some embodiments, the fifth elongated stud 620 may extend from the sole a distance L. In some embodiments, the back lateral stud 610 may extend from the sole distance K. In some embodiments, distance L may be equal to distance K. In other embodiments, the distance L may be less than the distance K. For example, in some embodiments, the distance L may be less than 60% of distance K. In other embodiments, the distance L may be greater than 60% of distance K. In some embodiments, the cleat configurations described in FIGS. 1-5 may also be included in the embodiment described in FIG. 6. For example, the angular relationships between the first elongated stud 36, second elongated stud 38, third elongated stud 32, fourth elongated stud 34, and back lateral stud 40 as discussed in FIG. 5 may be substantially similar to the angular relationships between the first elongated stud 630, second elongated stud 640, third elongated stud 660, fourth elongated stud 650 and back lateral stud 610 in FIG. 6. This angular relationship between the studs in the heel region allows the foot to roll slightly in the direction of the forefoot while advancing in a forward direction.

The fifth elongated stud 620 located in the back portion of the heel as shown in FIG. 6 may provide improved traction. For example, the player may place the heel portion of the foot on the ground first before the forefoot portion. In this case, the fifth elongated stud 620 gives the player improved traction before the forefoot reaches the ground, especially in circumstances where the player is planting a foot before kicking a ball. The heel configuration in FIG. 6 may also provide improved traction when running, accelerating, and/or making a directional change.

Figure 7:
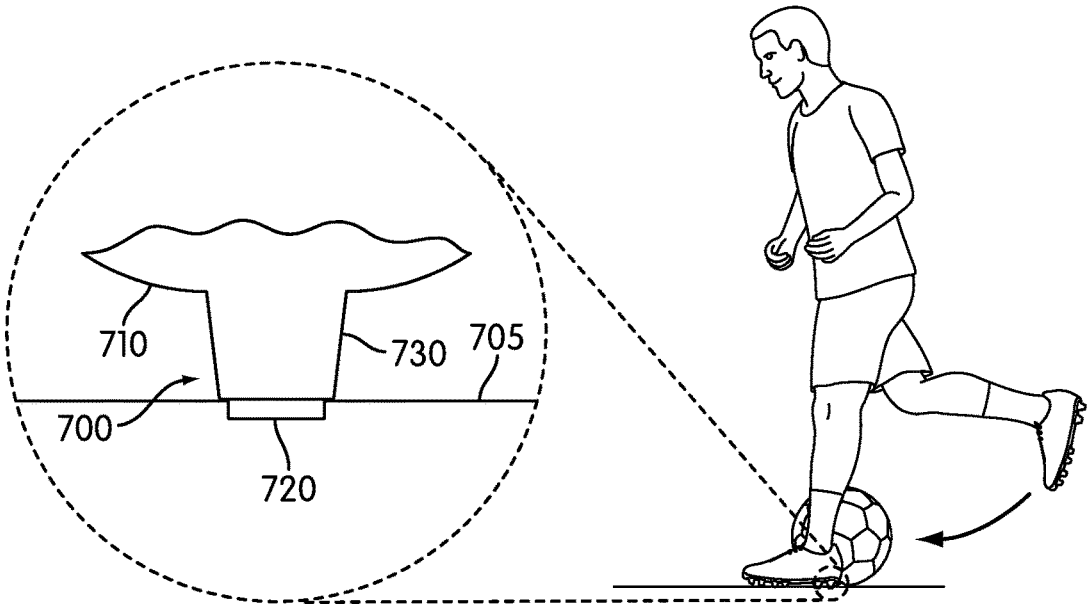
FIG. 7 is an enlarged view of the back lateral stud penetrating the ground.
Figure 8:
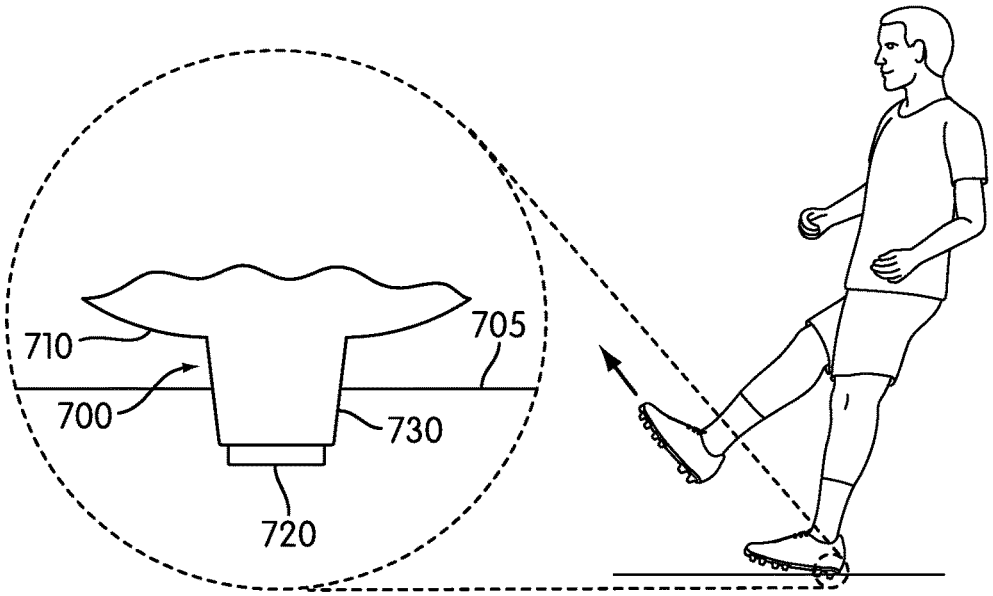
FIG. 8 is an enlarged view of the back lateral stud penetrating the ground.

FIGS. 7 and 8 are intended to illustrate schematic views of a back lateral stud penetrating into a ground surface during use. In particular, FIGS. 7 and 8 illustrate the process in which a smaller stud portion initially penetrates into a ground surface and helps a larger stud portion (from which the smaller stud portion extends) to penetrate into the ground surface.

Referring to FIG. 7, the back lateral stud 700 may be attached to the heel region 710 of an athletic shoe. The back lateral stud 700 may include a first stud portion 730 and an attached second stud portion 720. Generally, the arrangement of first stud portion 730 and second stud portion 720 may be substantially similar to the arrangement discussed above for first stud portion 316 and second stud portion 326. In particular, first stud portion 730 has an approximately rounded tapered shape and second stud portion 720 extends outwardly from an approximately flat surface at an end of first stud portion 730.

When the back lateral stud 700 first initiates contact with the ground 705, as shown in FIG. 7, the second stud portion 720 may enter the ground 705 first. The second stud portion 720 may create an initial hole by displacing a portion of the ground 705 making it easier for the rest of the stud to enter the ground 705. Because second stud portion 720 has a smaller radius than first stud portion 730, second stud portion 720 may insert more easily into ground 705 during the initial contact with ground 705.

As shown in FIG. 8, as the player shifts more weight onto the planted heel 710, the first stud portion 730 begins to penetrate the ground 705. In some cases, the initial hole created by second stud portion 720 helps facilitate further insertion of first stud portion 730 into ground 705. Thus, the second stud portion 720 effectively allows the first stud portion 730 to more easily penetrate the ground 705 in order to provide stability to the player.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

a sole structure having a heel region including a medial edge, a lateral edge, and a back edge extending between the medial edge and the lateral edge;

a plurality of medial elongated studs disposed proximate to the medial edge, each medial elongated stud extending from a first end to a second end along a longitudinal axis substantially parallel to the medial edge and protruding a first distance from a lower surface to a distal end;

a plurality of lateral elongated studs each disposed proximate to the lateral edge, each lateral elongated stud extending from a first end to a second end along a longitudinal axis substantially parallel to an adjacent portion of the lateral edge and protruding at least the first distance from the lower surface to a distal end;

a back stud disposed proximate to the back edge and protruding a second distance from the lower surface of the sole structure to a distal end, the second distance being less than the first distance; and a support structure extending from the back stud to at least one of the plurality of lateral elongated studs, wherein at least one of the plurality of medial elongated studs or the plurality of lateral elongated studs includes a first elongated stud vertically protruding from the lower surface of the sole structure at a first angle relative to a longitudinal axis of the sole structure, and a second elongated stud vertically protruding from the lower surface of the sole structure at a second angle relative to the longitudinal axis of the sole structure, the second angle being different from the first angle.

2. The article of footwear of claim 1, wherein the back stud has a circular cross section.

3. The article of footwear of claim 1, wherein the back stud is conical.

4. The article of footwear of claim 1, wherein the second distance is greater than 50% of the first distance.

5. The article of footwear of claim 1, wherein the back stud protrudes from the lower surface of the sole structure at a third angle different from the first angle and the second angle.

6. The article of footwear of claim 5, wherein the first elongated stud is disposed between the second elongated stud and the back stud.

7. The article of footwear of claim 1, wherein the back stud is proximate to the back edge on a lateral side of the sole structure.

8. The article of footwear of claim 1, wherein the back stud includes a first stud portion protruding from the lower surface of the sole structure to a top surface and a second stud portion protruding from the top surface to the distal end.

9. The article of footwear of claim 8, wherein the first stud portion tapers from a first radius at the lower surface of the sole structure to a second radius at the top surface, and the second stud portion has a constant third radius that is smaller than the second radius.

10. An article of footwear, comprising:

a sole structure having a lower surface including a heel region bounded by a medial edge, a lateral edge, and a back edge extending between the medial edge and the lateral edge;

a first elongated stud protruding a first distance from the lower surface of the sole structure to a first distal end, the first elongated stud disposed proximate to one of the medial edge and the lateral edge and extending from a first end to a second end along a first longitudinal axis substantially parallel with the one of the medial edge and the lateral edge;

a second elongated stud protruding a second distance from the lower surface of the sole structure to a second distal end, the second elongated stud disposed proximate to the one of the medial edge and the lateral edge and extending from a third end to a fourth end along a second longitudinal axis substantially parallel with the one of the medial edge and the lateral edge;

a back stud disposed proximate to the back edge and protruding a third distance from the lower surface of the sole structure to a distal end, the third distance being less than the first distance; and a support structure extending from the back stud to the first elongated stud or the second elongated stud, wherein the first elongated stud vertically protrudes from the lower surface at a first angle relative to a longitudinal axis of the sole structure, and the second elongated stud vertically protrudes from the lower surface of the sole structure at a second angle relative to the longitudinal axis of the sole structure, the second angle being different from the first angle.

11. The article of footwear of claim 10, wherein the back stud has a circular cross section.

12. The article of footwear of claim 10, wherein the back stud is conical.

13. The article of footwear of claim 10, wherein the third distance is greater than 60% of the first distance.

14. The article of footwear of claim 10, wherein the back stud protrudes from the lower surface of the sole structure at a third angle different from the first angle and the second angle.

15. The article of footwear of claim 14, wherein the first elongated stud is disposed between the second elongated stud and the back stud.

16. The article of footwear of claim 10, wherein the back stud is proximate to the back edge on a lateral side of the sole structure.

17. The article of footwear of claim 10, wherein the back stud includes a first stud portion protruding from the lower surface of the sole structure to a top surface and a second stud portion protruding from the top surface to the distal end.

18. The article of footwear of claim 17, wherein the first stud portion tapers from a first radius at the lower surface of the sole structure to a second radius at the top surface, and the second stud portion has a constant third radius that is smaller than the second radius.

* * * * *